United States Patent [19]

Perazzi

[11] Patent Number: 5,074,068

[45] Date of Patent: Dec. 24, 1991

[54] ARRANGEMENT FOR SELECTIVELY DISENGAGING THE HAMMERS IN TRIPPING MECHANISMS OF DOUBLE BARREL SHOTGUNS

[75] Inventor: Daniele Perazzi, Botticino Mattina, Italy

[73] Assignee: Manifattura Armi Perazzi S.p.A., Brescia, Italy

[21] Appl. No.: 576,205

[22] Filed: Aug. 29, 1990

[30] Foreign Application Priority Data

Apr. 12, 1990 [IT] Italy ..... 5154 A/90

[51] Int. Cl.[5] ..... F41A 19/21

[52] U.S. Cl. ..... 42/42.01

[58] Field of Search ..... 42/42.01, 69.01, 42.03

[56] References Cited

U.S. PATENT DOCUMENTS

| | | | |
|---|---|---|---|
| 2,233,861 | 3/1941 | Browning | 42/42.01 |
| 2,711,042 | 6/1955 | Simmons | 42/42.01 |
| 3,142,925 | 8/1964 | Miller | 42/42.01 |
| 3,786,588 | 1/1974 | Soana | 42/42.01 |
| 4,091,556 | 5/1978 | Katsenes | 42/42.01 |
| 4,310,981 | 1/1982 | Waddell | 42/42.01 |
| 4,315,377 | 2/1982 | Jenkins | 42/42.01 |
| 4,403,436 | 9/1983 | Jennie | 42/42.01 |
| 4,805,332 | 2/1989 | Perazzi | 42/42.01 |

FOREIGN PATENT DOCUMENTS

| | | | |
|---|---|---|---|
| 565084 | 7/1957 | Italy | 42/42.01 |

*Primary Examiner*—Michael Carone

*Attorney, Agent, or Firm*—McGlew & Tuttle

[57] ABSTRACT

An arrangement is described for the selective disengagement of the hammers in tripping mechanisms of shotguns with two barrels coupled side by side or superimposed. The arrangement comprises a connector mounted on the trigger and capable of pivoting lengthwise as well as transversely with respect to the tripping mechanism.

The connector is provided with tripping teeth which interact with the tripping levers of the hammers. There is also a rocking arm attached to the connector and mounted on a selective push lever which is slidably guided in a transverse direction on the lower surface of the under guard member of the shotgun, so as to define two positions of the rocking arm and of the connector. Two modes are then possible in order to strike the firing pins by first utilizing a first hammer and then the other, or vice versa.

3 Claims, 2 Drawing Sheets

ARRANGEMENT FOR SELECTIVELY DISENGAGING THE HAMMERS IN TRIPPING MECHANISMS OF DOUBLE BARREL SHOTGUNS

FIELD OF THE INVENTION

The present invention relates, in general, to tripping mechanisms with two hammers and one trigger for shotguns with two barrels coupled to each other either side by side or superimposed. More particularly, the invention relates to an arrangement for the selective disengagement of the hammers, the arrangement being attached to the tripping mechanism so as to selectively disengage first one hammer and then the other, or vice versa, and fire the projectile first in one barrel and then in the other, in accordance with a reversible sequence.

BACKGROUND OF THE INVENTION

Already well known are various types of tripping mechanisms that comprise two hammers hinged on an under guard member and respectively coordinated with the firing pins of the barrels, two tripping rods (hereafter simply referred to as rods) for arresting the hammers in the cocked position, and a trigger that controls separately—through an inertial mass or rocking arm—the movement first of one rod and then of the other for the successive disengagement of the two hammers, the trigger being connected to the rocking arm by means of a pivoting connector mounted on the tail of the trigger and vertically movable therewith.

Similar tripping mechanisms, also known as monotrigger mechanisms, may further comprise a firing selective device that permits the selective disengagement first of the hammer related to one barrel and then of the hammer related to the other barrel, or vice versa, depending on the requirements of the user.

Among others, there is known for instance from Italian patent application no. 5238-A/87 corresponding to U.S. Pat. No. 4,805,332 of the firm of the present applicant, a selective device consisting of a sliding selector mounted on and movable transversely on an intermediate part of the pivoting connector of the mechanism, and interacting with the rods of the hammers, the sliding selector being arrested in each of the two positions by a spring-loaded piston.

Such an operation, however, calls for a sliding mount of the slide selector on the connector and, even more disadvantageously, a direct access to the mechanism, which involves the disassembly of the mechanism itself from the rocking arm. The operation of the selective device is, therefore, quite troublesome and not so practical.

SUMMARY AND OBJECTS OF THE INVENTION

The purpose of the present invention is to eliminate the above mentioned disadvantage and inconvenience and to permit a quicker and more practical operation of the selective mechanism directly from the outside without removing the mechanism from the rocking arm of the shotgun.

This result is achieved by providing a selective hammer disengagement arrangement of the type here above described with disengaging teeth as integral components of the pivoting connector and with a controlling push lever transversely guided on the outer surface of the under guard member and attached to the rocking arm in such a manner as to be able to position the rocking arm in one of two positions to which correspond two distinct modes of interaction of the disengaging teeth with the rods of the hammers for the selected disengagement first of the right hammer or of the left one.

The selective disengagement mechanism here proposed includes a pair of hammers hinged to an under guard member and coordinated with respect to firing pins corresponding to the two barrels of the shotgun; a pair of tripping rods for arresting said hammers in the cocked position; a trigger controlling separately, through a rocking arm, the individual displacement of said tripping rods for the successive disengagement of said hammers; a connector connecting said trigger with said rocking arm, said connector being mounted on and being vertically displaceable with the tail of said trigger; said connector being pivotable lengthwise as well as transversely of the tripping mechanism; at least a central tooth fixedly positioned on said connector and laterally thereto a pair of catches opposed to each other, said catches being positioned rearwardly with respect to said central tooth; and, a guided selective push lever, carrying mounted thereon said rocking arm, transversely slidable on the lower surface of said under guard member, so as to define two positions of said rocking arm and said connector and provide for two striking modes of said hammers. is substantially in accordance with claim 1, hereto appended, and is equally applicable to tripping mechanisms with fixed-position triggers and to mechanisms with variable-position triggers.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings.

An example of practical realization of the arrangement of the present invention will be hereinafter fully described with reference to the accompanying illustrative, but not limitative drawings, in which.

DETAILED DESCRIPTION OF THE DRAWINGS

Figure 1:
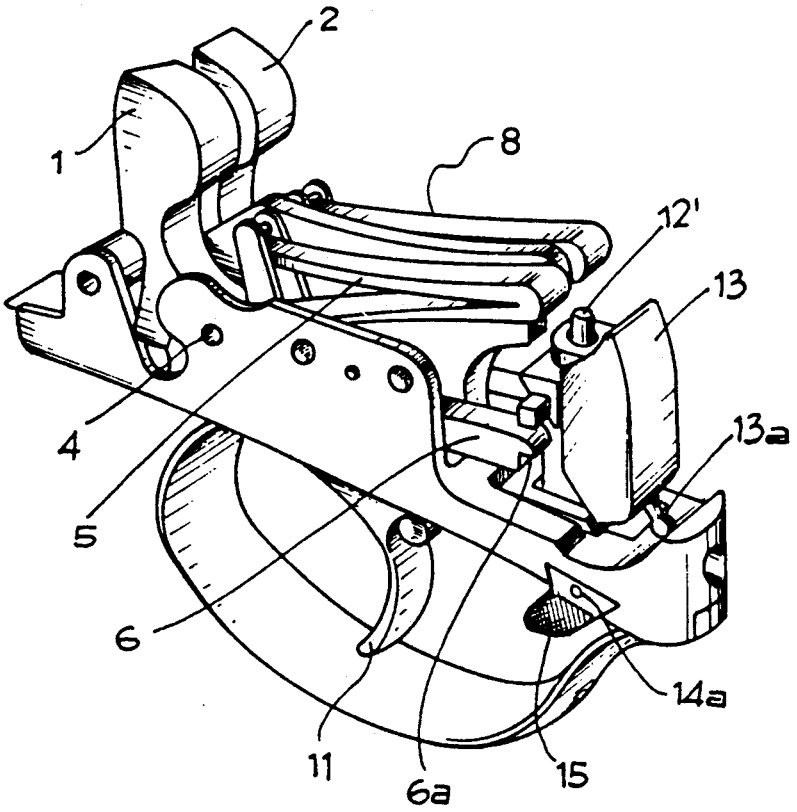
FIG. 1 is a perspective view of the mechanism of the invention.
Figure 4:
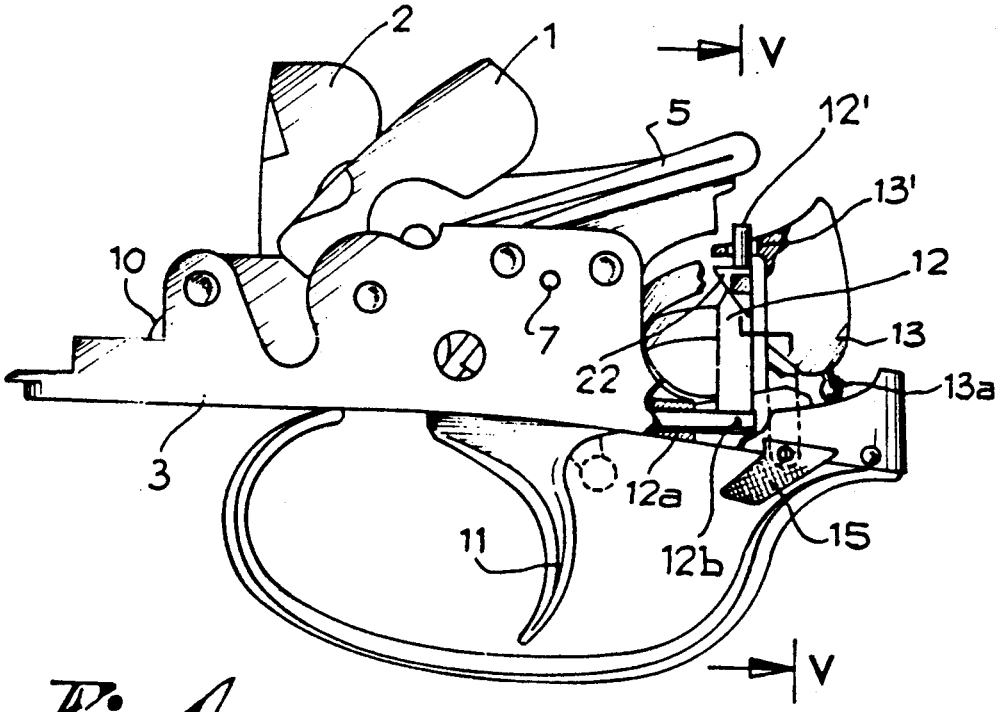
FIG. 4 is a partial, sectional side view of the arrangement.

The tripping mechanism of the invention comprises two hammers 1 and 2, hinged on under guard member 3 by means of pin 4 and serving to strike the firing pins corresponding to the two barrels of the shotgun, mounted side by side or superimposed (not shown in the accompanying drawings).

Hammer 1 is actuated upon, as it is known per se, by a tripping spring 5 and it is hooked in the cocked position by means of rod 6 pivotably mounted on pin 7 and terminating rearwardly with beak 6*a*. Similarly, hammer 2 is acted upon by a tripping spring 8 and it is hooked in the cocked position by means of rod 9 which is equally pivotably mounted on the same pin 7 and terminating rearwardly with beak 9*a*.

The displacement of hammers 1 and 2 in the cocked position is determined by driving levers 10 controlled by the opening of the barrels. Conversely, the disengagement of the hammers for the striking operation is controlled by a single trigger 11 in accordance with a reversible sequence, as more fully described hereinafter. On the tail of trigger 11, which tail may be either in a fixed position or in a variable position, there is a pivoting connector 12, positioned back of rods 6 and 9 and movable vertically with the trigger. Connector 12 is provided with two orthogonal, rotational axes, in such a manner that it be able to oscillate or pivot on pin 12*a* (associated with the trigger) in a direction transverse with respect to the tripping mechanism, as well as on pin 12*b* (attached to pin 12*a*) in the lengthwise or breadthwise direction of the mechanism. Connector 12, furthermore, connects the trigger to an inertial mass or rocker arm 13 by means of a small rod 12', which is an integral component of the connector 12 and engages a corresponding opening 13' provided in the rocker arm 13. Connector 12 pivots on the transverse axis of pin 12*b* together with the rocking arm. This latter, through a transverse pin 14*a*, is hinged beneath to a sliding selective push lever 15 mounted and guided in a transverse seat 3*a* provided in the outer surface of the under guard member 3, behind the trigger 11.

The rocker arm 13 is actuated by a spring which keeps it normally displaced toward the tripping rods 6 and 9, together with the connector 12. The sliding push lever 15 has the function of displacing transversely into one of two positions the rocking arm 13 and, through the latter, of causing the transversal pivoting of the connector 12 on pin 12*a*, in accordance with the two modes of disengagement of the hammers 1 and 2. The two positions of the rocker arm 13 (and also of the connector 12) are defined by an elastic arrestor consisting, for instance, of a spring-peg combination 17,18 mounted in the push lever and engaging notches provided in the base of the guide seat 3*a*.

In order to selectively disengage hammer 1 or hammer 2 and be able to fire projectiles first from one barrel and then from the other, or vice versa, the connector 12 has integrally therewith, in its intermediate section, a central tripping tooth 19, which cooperates, alternately, with beak 6*a* of the rod 6 and with beak 9*a* of the rod 9, depending on the position of the connector itself. On opposite sides of the central tooth 19, the connector has two tripping catches 20 and 21, rearwardly positioned with respect to the central tooth 19 and, therefore, farther distanced from the beaks 6*a* and 9*a* of the rods 6 and 9.

Catch 20 cooperates with beak 6*a* of rod 6 when central tooth 19 is engaged with beak 9*a* of rod 9. Conversely, catch 21 cooperates with beak 9*a* of rod 9 when the central tooth 19 is engaged with beak 6*a* of rod 6.

Figure 2:
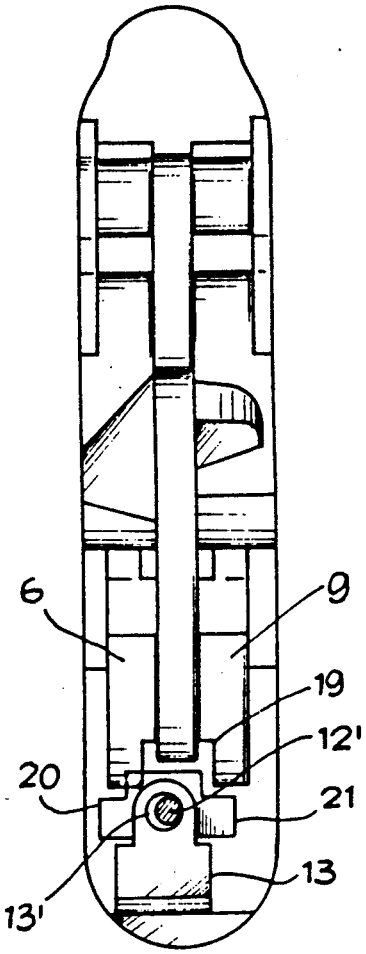
FIG. 2 is a top view of the mechanism, with the hammers' springs previously removed and with the arrangement in a first operative position.
Figure 5:
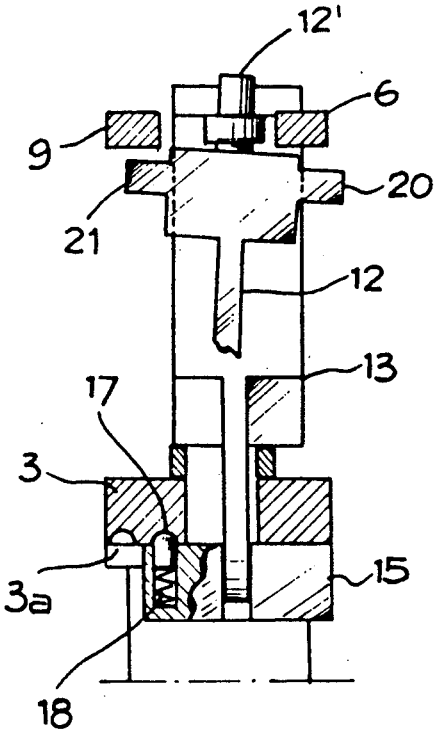
FIG. 5 is a sectional detail of the arrangement, taken along arrows V—V of FIG. 4.

Beneath the central tooth 19 there is provided a chamfer 22 against which acts the rear end of either of the two rods 6 and 9, so as to displace temporarily and rearwardly the connector 12 and, together therewith, the rocker arm 13 during the cocking or arming of the hammers. In practice, when the push lever 15 is moved fully to the left (see FIG. 2), the connector 12 is also displaced to the left (solid lines in FIG. 5), and its central tooth 19 is positioned beneath and cooperates with beak 6*a* of rod 6 of hammer 1 without interference with the beak of rod 9 of the other hammer 2. In this condition, when the hammers are cocked, by acting a first time on the trigger 11 the connector 12 is displaced upwardly, the central tooth 19 acts on rod 6, hammer 1 is thus disengaged and the firing of the projectile through the corresponding barrel occurs.

When the trigger is released, connector 12 is displaced downwardly and, actuated by the rocker arm 13 (urged by spring 13*a*) moves forward toward the rods 6 and 9 to a position wherein it can place the catch 21 beneath beak 9*a* of the other rod 9. In this way, by depressing a second time the trigger 11, the rod 9 is displaced (through catch 21) and the other hammer 2 is disengaged.

Figure 3:
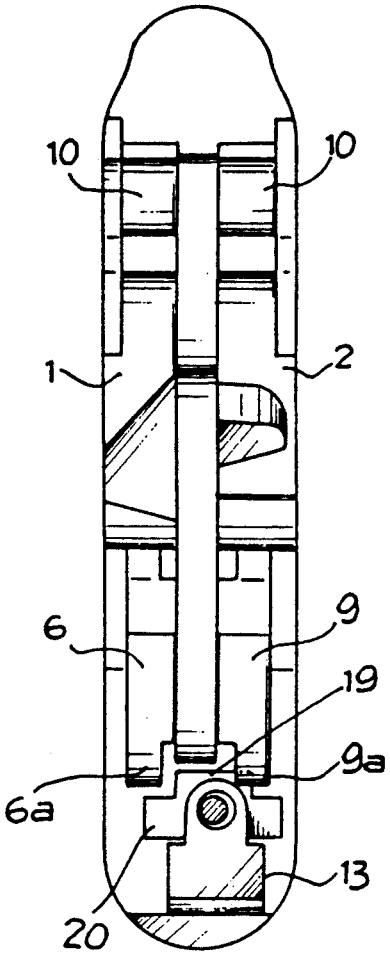
FIG. 3 is another top view, analogous to that of FIG. 2, except that the arrangement is in a second operative position.

When, on the other hand, the selective push lever 15 is moved to the right, as shown in FIG. 3, the opposite effect is obtained, that is, the tooth 19 is positioned beneath and cooperates with the beak 9*a* of rod 9 of hammer 2, so as to disengage first the latter following a first operation of the trigger 11. Subsequently, after having released the trigger 11, the catch 20 of connector 12 engages beak 6*a* of rod 6, so that when the trigger is again depressed, the hammer 1 is disengaged.

It is therefore quite evident how the two firing modes may be selectively utilized by simply and easily acting on the selective push lever without need of accessing the interior of the mechanism.

While a specific embodiment of the invention has been shown an described in detail to illustrate the application of the principles of the invention, it will be understood that the invention may be embodied otherwise without departing from such principles.

What is claimed is:

1. An arrangement for selectively disengaging the hammers in a tripping mechanism of shotguns with barrels coupled side by side or superimposed, comprising:

a pair of hammers hinged to an under guard member and coordinated with respect to firing pins corresponding to the two barrels of the shotgun;

a pair of tripping rods for arresting said hammers in the cocked position;

a trigger controlling separately, through a rocker arm, the individual displacement of said tripping rods for the successive disengagement of said hammers; a connector connecting said trigger with said rocker arm, said connector being mounted on and being vertically displaceable with the tail of said trigger; said connector being pivotable lengthwise as well as transversely of the tripping mechanism;

at least a central tooth fixedly positioned on said connector and laterally thereto a pair of catches opposed to each other, said catches being positioned rearwardly with respect to said central tooth; and, a guided selective push lever, carrying mounted thereon said rocker arm, transversely slidable on the lower surface of said under guard member, so as to define two positions of said rocker arm and said connector and provide for two striking modes of said hammers.

2. The arrangement according to claim 1, wherein said connector is mounted on said trigger through a first pin that permits transverse pivoting of said connector, said connector being further hinged on said first pin through a second pin that permits longitudinal pivoting of said connector.

3. The arrangement according to claim 1, wherein said selective push lever is guided within a seat provided in said under guard member and accessible from the outside, and is displaceable to two positions defined by arresting means mounted on said lever and interacting with said under guard member.

* * * * *